US010974158B1

(12) United States Patent
Herren

(10) Patent No.: US 10,974,158 B1
(45) Date of Patent: Apr. 13, 2021

(54) PORTABLE BALLOON TYING DEVICE WITH REDUCED FATIGUE-INDUCING DISTAL EDGE

(71) Applicant: Gerald R. Herren, Cookeville, TN (US)

(72) Inventor: Gerald R. Herren, Cookeville, TN (US)

( * ) Notice: Subject to any disclaimer, the term of this patent is extended or adjusted under 35 U.S.C. 154(b) by 100 days.

(21) Appl. No.: 16/262,177

(22) Filed: Jan. 30, 2019

Related U.S. Application Data

(63) Continuation-in-part of application No. 15/694,655, filed on Sep. 1, 2017, now Pat. No. 10,549,208.

(51) Int. Cl.
*A63H 27/10* (2006.01)

(52) U.S. Cl.
CPC ..... *A63H 27/10* (2013.01); *A63H 2027/105* (2013.01); *A63H 2027/1041* (2013.01)

(58) Field of Classification Search
CPC ..... A63H 27/10; A63H 2027/1041; A63H 2027/105; A63H 2027/1033; D03J 3/00; A01K 91/04; B65H 69/04
USPC ..... D8/40
See application file for complete search history.

(56) References Cited

U.S. PATENT DOCUMENTS 888,580 A 5/1908 Brinn
1,008,190 A 11/1911 O'Connell
1,051,155 A * 1/1913 O'Connell ..... A01K 91/04 289/17
1,731,574 A 10/1929 House
2,005,129 A * 6/1935 Chase ..... B65H 69/02 57/22
2,800,736 A * 7/1957 Beilharz ..... A01K 97/00 289/17
2,810,379 A 10/1957 Solomon
2,825,592 A 3/1958 Semple
3,177,021 A 4/1965 Benham
3,572,788 A 3/1971 Cruzan
3,837,691 A 9/1974 Smythe
4,029,346 A 6/1977 Browning
4,333,257 A * 6/1982 Burrell ..... A01K 91/04 30/298
4,864,762 A 9/1989 Cox
4,989,906 A 2/1991 Peverley
5,039,142 A 8/1991 Muma
5,098,137 A 3/1992 Wardall
5,314,217 A 5/1994 Place
5,568,950 A 10/1996 Herren
5,820,169 A 10/1998 Butler et al.
6,273,479 B1 8/2001 Carlson
(Continued)

FOREIGN PATENT DOCUMENTS

CN 204502395 U * 7/2015

*Primary Examiner* — Ismael Izaguirre
(74) *Attorney, Agent, or Firm* — Baker Donelson; Carl M. Davis, II

(57) ABSTRACT

A portable balloon tying device having a vertically extending tube with a first end and an opposing second end joined by a transition and an elongated channel extending outwardly as a cantilever from the transition. The first end defines a lower extent of a radiused arcuate surface for being received against a web of a hand between adjacent fingers of a person for using the portable balloon tying device, to cushion a loading and movement of the portable balloon tying device against the web which reduces fatigue and hurting during balloon tying use.

9 Claims, 7 Drawing Sheets

(56) References Cited

U.S. PATENT DOCUMENTS

| | | | |
|---|---|---|---|
| 6,902,212 | B1 | 6/2005 | Mize |
| 7,967,344 | B2 | 6/2011 | Herren |
| 8,292,335 | B1 | 10/2012 | Hemingway |
| 2011/0253255 | A1 | 10/2011 | Dellaquila |

* cited by examiner

PORTABLE BALLOON TYING DEVICE WITH REDUCED FATIGUE-INDUCING DISTAL EDGE

The present application is a continuation-in-part of co-pending U.S. patent application Ser. No. 15/694,655, filed Sep. 1, 2017.

TECHNICAL FIELD

This invention relates to hand-held devices that aid in tying knots in balloon necks and more particularly to portable devices with support structures to comfortably aid in hand-tying half-hitch knots, especially in necks of balloons and the like. Spooled and pre-cut ribbon can be tied integral with the knot.

BACKGROUND OF INVENTION

Balloons with ribbons and the like are generally tied with a half-hitch knot. First, a loop is made in the balloon tail, passing the end over the standing part, then passing the end under the standing part and through the loop. See The World Book Dictionary, Clarence L. Barnhart and Robert K. Barnhart, editors, World Book, Inc., publisher, 1990, page 956, column 3. The loop is usually made around one or more fingers, which has disadvantages, among which are: 1. Difficulty of passing the end through the loop, because the material is generally kept very tight to prevent air or gas from escaping from the balloon; 2. Damage to the material while tying the knot therein; 3. Fatigue of the hands, especially the fingers, due to tying many balloons; 4. Extra time is often required to avoid or cope with the above listed disadvantages.

There are various commercially available devices which can be attached to the open ends of balloons to seal the air or gas there inside. Such products do not relate to the invention because when such devices are removed from the balloon, the air or gas escapes therefrom.

Other devices, such as that disclosed by Peverley in U.S. Pat. No. 4,989,906, issued on Feb. 5, 1991, attach to fixed support means via a bracket. Such devices are not generally portable since they must be secured to a fixed support. There is a need for a balloon tying device which can be held in the hand or positioned on a stanchion while operated with both hands to facilitate easy tying of balloons.

U.S. Pat. No. 7,967,344 shows a portable balloon tying device. While this device provided a great leap in the ability to tie a balloon, improvements to this type of device could improve the ability to quickly and efficiently tie balloons so that the balloon did not fall off the end of the device during the tying process. Conversely, an improvement could enable an overly stretched balloon to more easily be removed from the device.

While the foregoing discloses a portable balloon tying device that successfully fixes a knot in a neck portion of an inflated balloon, a need exists to resolve an operational drawback that arises from repeated operation of the device by a balloon inflatest. The drawback is the bearing load and movement of the base against a web portion of the hand during operation of the portable balloon tying device. As explained, the base of the device slides over two fingers of one hand, for example the first and second fingers lateral of the thumb. This disposes an end wall of the base between the second and third fingers lateral of the thumb, with a lower edge bearing on the web of the hand between the adjacent fingers. The loading and movement occurs as a balloon neck is stretched laterally from one side to the other of the open cantilever, wrapped around the cantilever to cross over the stretched neck, and looped over and pulled longitudinally under to form the knot and dislodge the knotted neck from the cantilever. The loading and movement on the web fatigues the hand while holding the device and forming the knot in a plurality of balloons in an extended period, and such may bruise and hurt the hand of the balloon tying operator. This therefore limits the number of balloons that can be comfortably knotted before a rest period may be necessary.

Accordingly, there is need in the art for an improved balloon tying device providing a more comfortable fitting of the base to the hand to reduce fatigue and bruising. It is to such that the present invention is directed.

SUMMARY OF THE INVENTION

The present invention meets the need in the art by providing a portable balloon tying device having improved operational fitting to a hand of a person for tying a knot in a neck of an inflated balloon, comprising a vertically extending tube configured for receiving a support structure, said tube having a first end and an opposing second end joined by a back side transition and an opposing front side transition. An elongated channel extends outwardly as a cantilever from said front side transition. The first end defines a lower extent having a radiused arcuate surface. The radiused arcuate surface of the first end is configured to be received against a web of the hand between adjacent fingers of the person for using the portable balloon tying device with the back side transition configured to be received outwardly of a back side of the fingers and the front side transition configured to overlie a palm side of the fingers, and configured to cushion a loading by and movement of the portable balloon tying device against the web during balloon tying use.

In another aspect, the present invention provides a portable balloon tying device having improved operational fitting to a hand of a person for tying a knot in a neck of an inflated balloon, comprising a vertically extending tube configured for receiving a support structure, said tube having a first end and an opposing second end joined by a back side transition and an opposing front side transition. The tube defines at a lower extent a radiused arcuate surface therealong of the first end, the back side transition, and the second end. A brace tab extending from the front side transition terminates at a distal edge for stabilized resting on a portion of a support structure during use of the balloon tying device. A pair of opposing bevels each defined on a surface of the brace tab proximate a respective side edge and the distal end of the brace tab, provide for bearing contact with a portion of the support structure during use for balloon tying purposes. An elongated channel extends outwardly as a cantilever from said front side transition. The radiused arcuate surface of one of the respective first end and second end being is configured to be received against a web of the hand between adjacent fingers of the person for using the portable balloon tying device for balloon tying purposes with the back side transition configured to be received outwardly of a back side of the fingers and the front side transition configured to overlie a palm side of the fingers, and configured to cushion a loading and movement of the portable balloon tying device against the web during use for balloon tying purposes.

Beneficial advantages and features of the present invention may readily be ascertained upon a reading of the following detailed description in conjunction with the drawings and the appended claims.

DETAILED DESCRIPTION

Figure 1:
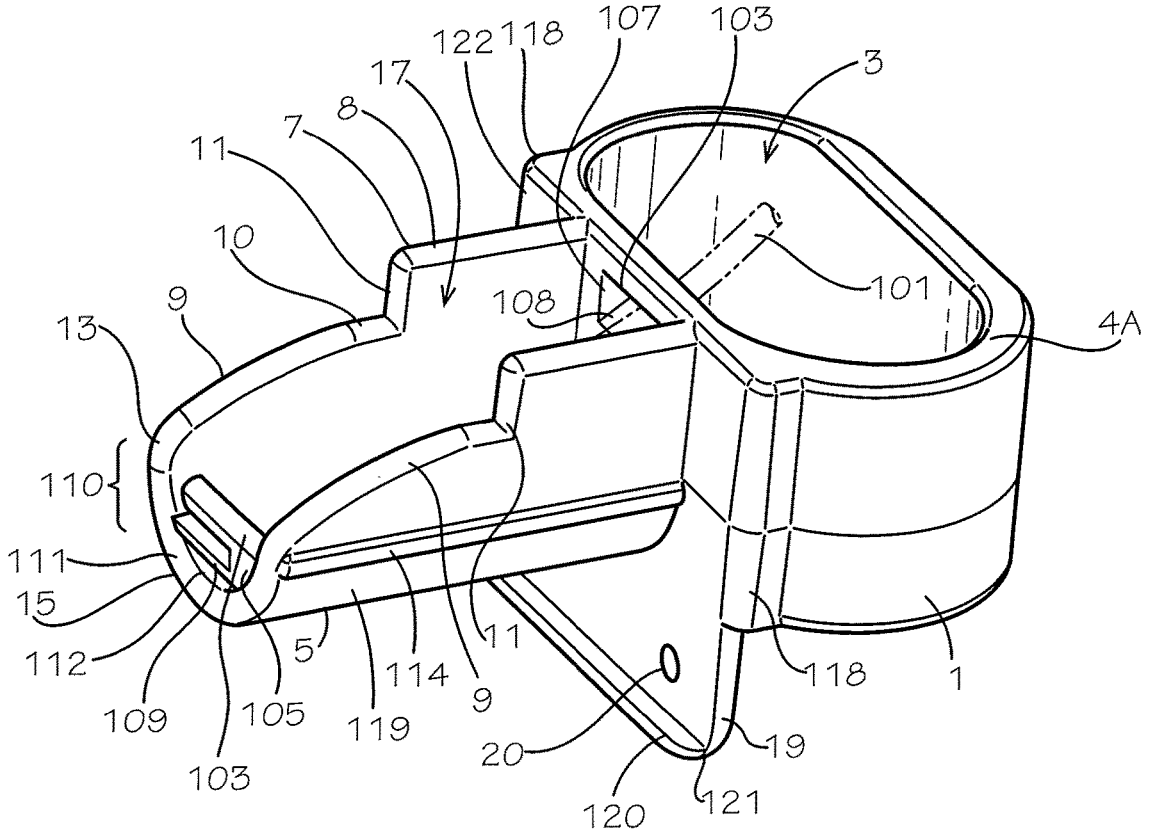
FIG. 1 illustrates in perspective view a balloon tying device having structural features in illustrative embodiments according to the present invention.
Figure 2:
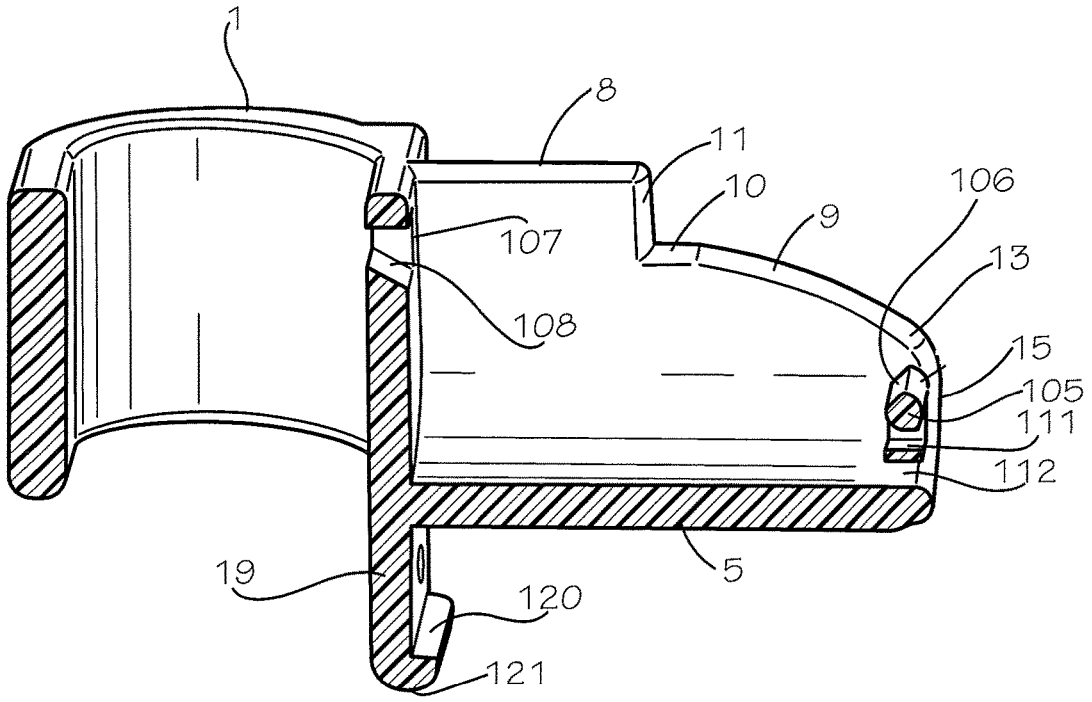
FIG. 2 illustrates in cross-sectional view the balloon tying device of FIG. 1.

With reference to the drawings in which like parts have like reference numerals, there is shown a portable balloon tying device in a preferred form of the invention. The device includes an generally oblong shaped tubular base 1 which supports a U-shaped balloon mounting flange or cantilever 5. The U-shaped cantilever has opposing side walls and a curved bottom. The base 1 is hollow having a generally oblong shaped opening 3 to assist in mounting to a support structure, such an operator's fingers, preferably first and second fingers, or a stanchion in a tying station, a tank stand, a caddy leg, or a waist belt device. It should be noted that the wall of the base 1 is thicker on one end 4*a* so as to make the opening 3 somewhat asymmetrical to conform better to human fingers. During use of the device, the end wall 4*a* of the base 1 that is thicker is inwardly lateral of an outer side (or thumb-side) of the operator's hand and thus, interior of the hand for disposing the end wall portion 4*a* between adjacent fingers.

Proximal to the base 1, each side wall of the cantilever 5 has an ear 7 having a generally horizontally extending top edge 8 which terminates at a vertically extending retaining edge 11. The two ears 7 are generally parallel due to the U-shape of the cantilever 5.

A generally horizontal bottom edge or plateau 10 extends from the retaining edge 11. The purpose of the plateau 10 is to keep the balloon tying operation sufficiently above the supporting hand to allow sufficient clearance for manipulation of portions of the balloon with the cantilever 5 with the other hand during balloon-tying operations. An arcuate or curved holding edge 9 extends directly from the bottom edge 10 to an end 15 of the cantilever 5. Near the end 15, the holding edge 9 preferably has an increasing radius 13 for ensuring that the balloon is not damaged upon removal from the device. The purpose of the holding edges 9 is to provide an opening there between to allow sufficient clearance for manipulation of the balloon through the opening with the other hand. The arcuate or curved shape of the holding edge 9 also facilitates the removal of a tied balloon by reducing the circumference of the stretched portion of the balloon about the cantilever 5 and therefore promoting the rolling-off of the tied balloon from the cantilever.

An axially oriented trough or recess 17 extends from the base 1 and between the ears 7 and holding edges 9 to the end 15 for establishing a space or opening through which a thumb and a finger of the other hand of a balloon-tying operator can push and pull the end of a balloon in order to complete a knot. The recess 17 should therefore be at least ⅝ inch wide, and preferably ¾ inch wide to fit most normal sized human fingers.

Spooled ribbon or pre-cut ribbon 101 may be routed through the axially oriented recess 17 and positioned to rest in the center opening thereof such that when the knot is cinched, the ribbon passes through the core of the knot thereby making the ribbon integral with or secured by the knot. This enables construction of a balloon arch on a continuous ribbon and also allows one or more individual ribbons to be attached for each balloon. The invention can integrate either a single ribbon or multiple ribbons of the same color or different colors in the balloon knot.

A proximal ribbon retainer 103 in the form of a ribbon retainer slot 107 extends through the base 1 between the ears 7. The ribbon retainer slot 107 includes an inclined floor or surface 108 which rises as the floor 108 extends from proximal the cantilever 5 (exterior surface of the base) to distal the cantilever 5 (interior surface of the base). The inclined surface 108 aids in pushing the ribbon through the slot 107 towards the end 15 of the cantilever for ease in grasping and guiding the ribbon as it passes through the slot 107.

A distal ribbon guide generally 110 is positioned closely adjacent the end 15 of the cantilever 5. The ribbon retainer guide 110 in the illustrated embodiment includes a bridge 111 extending between the interior walls of the cantilever 5 and an adjacent ribbon retainer 105. The bridge 111 is spaced above the curved bottom surface of the cantilever 5 and defines a passage gap 112. The passage gap 112 receives ribbon(s) therethrough as discussed below during balloon tying operations. The bridge 111 and passage gap 112 are positioned such that a ribbon extending longitudinally along the cantilever 5 from the base 1 may remain positioned in the lower quadrant of the axially oriented recess 17 thereby allowing easy access for fingers to the balloon during tying operations. The bridge 111 is gainfully used during balloon arch construction operations as discussed below.

The disclosed device further provides a second ribbon receiving retainer slot with the distal ribbon retainer 105. The distal ribbon retainer 105 is a cantilever flange member attached to a first one of the walls of the cantilever 5 vertically spaced from the bridge 111. The ribbon retainer 105 extends towards the opposing wall to leave a gap between a distal end of the retainer 105. The vertical spacing of the ribbon retainer 105 defines a ribbon receiving slot 109 between the retainer 105 and the bridge 111. The ribbon retaining slot 109 is thereby open at one end to enable a ribbon(s) to be slid laterally into the slot 109, during balloon tying operations as discussed below.

A top surface 106 of the distal ribbon retainer 105 is angled upwardly as it extends from a side portion towards the end 15 to prevent longer fingernails of a balloon-tying operator from contacting or catching on the distal ribbon retainer 105 during use of the device. The proximal ribbon retainer 103 and distal ribbon retainer 105 are positioned such that the ribbon 101 remains positioned in the lower quadrant of the axially oriented recess 17 thereby allowing easy access for fingers to the balloon during tying operations. The ribbon retainer 105 is gainfully used during single balloon tying operations as discussed below.

The bridge 111 and the ribbon retainer 105 are preferably recessed inwardly from the end 15 of the cantilever and recessed below the upper surface of the arcuate holding edge 9, so that the tie portions of the balloon move over without contacting during a tied balloon removal step. The illustrated embodiment according includes both the bridge 111 and its passage gap 112 and the ribbon retainer 105 and its slot 109, for use of the device for single balloon tying operations or selectively for balloon arch construction operations. Alternate embodiments having only one of the ribbon slots may be gainfully employed (a) with the bridge 111 and passage gap 112 configured only for single balloon tying operations or (b) with the ribbon retainer 105 and slot 109 for balloon arch construction operations.

Figure 3:
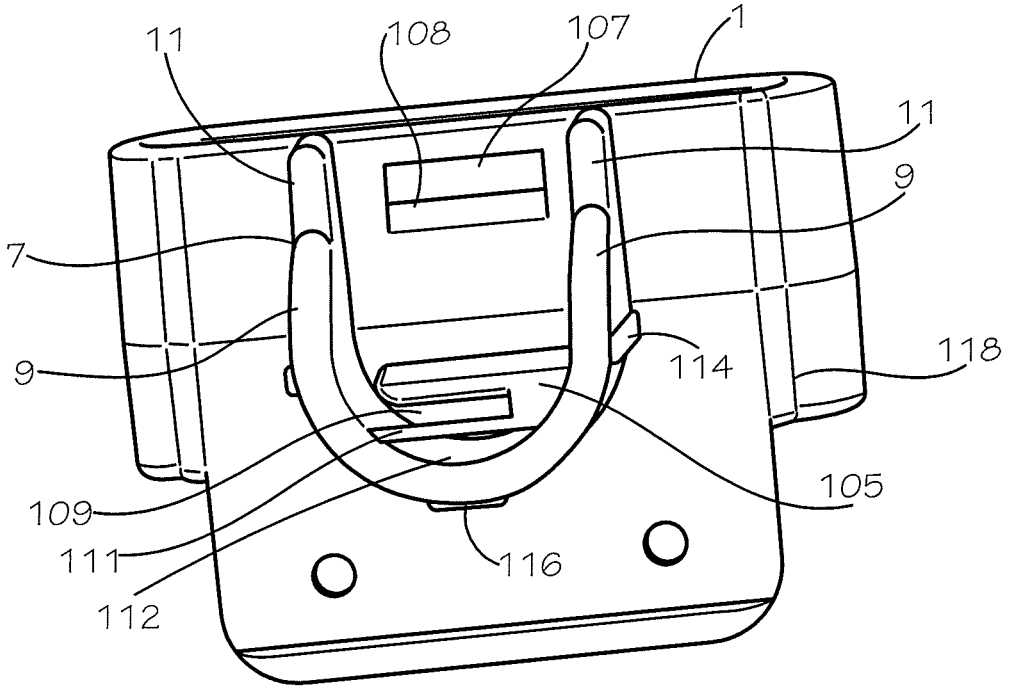
FIG. 3 illustrates in a front, perspective view the balloon tying device of FIG. 1.
Figure 4:
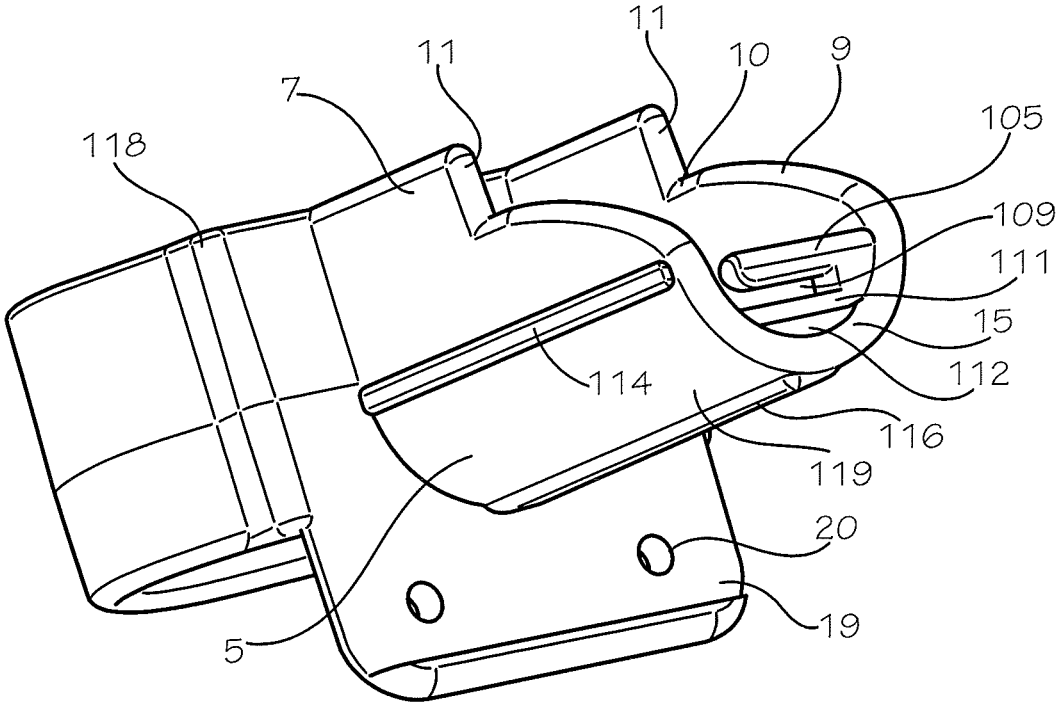
FIG. 4 illustrates in a bottom, perspective view a portion of the balloon tying device of FIG. 1.

The exterior or outer surface of the cantilever 5 includes three longitudinally extending ridges; specifically in the illustrated embodiment, there are two oppositely disposed side ridges 114 and a bottom ridge 116, as best illustrated in FIG. 3. The purpose of the ridges 114 and 116 is to minimize contact of the balloon skin and device surface, and therefore reduce friction, between the wrapped balloon and the cantilever 5. Minimizing friction between the balloon and the cantilever 5 aids in pulling the tied balloon off the cantilever. The exterior surface of at least the cantilever 5 may also be provided with a matte finish 119, for example in the illustrated embodiment, a SPI A-3 finish, to aid in the removal of the balloon. The matte finish aid removal by reducing surface friction between the balloon and the cantilever 5 surface. Further, the matter finish provides a softer feel for placing the device on an operator's hand as well as provide an overall uniform ornamental appearance when formed over the entire surface.

A brace tab 19 extends downward from the base 1 to a distal edge, for resting on a portion of the support structure to stabilize the tying device. The distal edge may define an arcuate face. In the illustrated embodiment, a flange 120 extends laterally from the distal bottom portion of the brace tab 19. The flange 120 extending laterally therefrom has an arcuate surface 121 to provide a wider broader edge than the brace tab 19 without the flange, for more comfortable holding and stabilized resting on a portion of a support structure such as a upper palm portion of an operator's hand during use of the device for balloon tying operations. The arcuate edge 121 assists use processes in that during such the edge more comfortably distributes loading imposed by the balloon tying operations on the palm of the operator. Further, many, if not all, corners and edges of the device are preferably rounded or curled as shown in the drawings to ensure comfort and ease of use. The base tab 19 includes two mounting holes 20 therethrough through which screws may pass to secure the device to a support.

At the junction of the cantilever 5 to the base 1 the base includes two oppositely disposed, vertically extending elongated shoulders or seal offs 118. The shoulders 118 provide a high relief ridge that aids in providing a contact point or ridge for the operator's thumb to press against when sealing the neck of the balloon during the tying process. The shoulders 118 are preferably arcuate. The elongated shoulders 118 are spaced-apart laterally from an exterior surface of a respective one of the ears 7, such that a curved end of the base 1 is lateral of the cantilever 5 by a portion 122 of the brace tab 19 that is co-extensive and defines a wall of the base 1. The spaced-apart shoulders 118 and portion 122 facilitates balloon tying operations with thumb bearing surfaces for sealing the balloon from escape of air or gas during balloon tying operations. The thumb of the operator's hand holding the device with fingers through the base 1 may push balloon tail against the shoulder 118 and/or slip into the angled portion of the face portion 122 of the brace tab 19 and the ear 7 while sealing the balloon tail from escape of air or gas during balloon tying operations.

Figure 5:
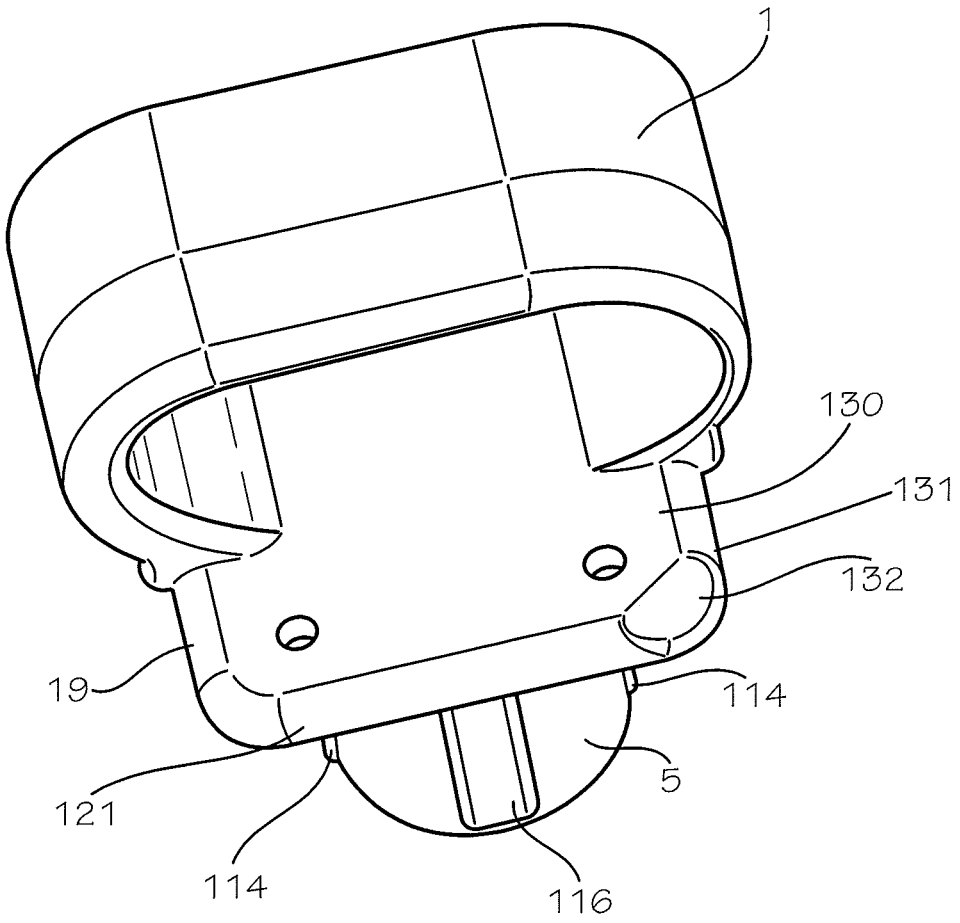
FIG. 5 illustrates in a back, perspective view the balloon tying device of FIG. 1.

FIG. 5 illustrates in a back, perspective view the balloon tying device of FIG. 1 depicting a back 130 of the brace tab 19 proximate the base 1. A corner portion 131 of the back 130 a proximate a side edge and the distal end 121 of the brace tab 19 defines a planar bevel surface 132. The bevel surface 132 during use of the device bears against the palm of the operator's hand intermediate the finger and the thumb. The tapered surface facilitates fit and loading on the hand during balloon tying operations of pulling a tail portion of the balloon and making the knot.

The device is preferably constructed of plastic, and is preferably fabricated by injection molding preferably as a unitary body, or alternatively although more expensive, snap assembled of parts although relative parts may flex during balloon tying operations. However, any suitable conventional material can be used, and any suitable conventional fabrication means can be used.

A preferred method of using the device is illustrated in sequential FIGS. 5-8 of U.S. Pat. No. 7,967,344 which is specifically incorporated herein by reference in its entirety. The device is slid over two fingers of one hand 16 (shown in FIGS. 5-8 of U.S. Pat. No. 7,967,344) with the fingers extending through opening 3. For single balloon tying operations, a ribbon 101 is passed through the fingers and held in position, clear of the tying fingers, by ribbon retainer 103 and distal ribbon retainer 105 with the ribbon positioned in ribbon retainer slots 107 and 109. The invention can be used in this manner over any one or more fingers and can also mount on another support structure such as a stanchion in a tying station, a tank stand, a caddy leg, or a waist belt device.

An inflated balloon 20 is then held with the thumb 18 of the one hand 16 bearing the balloon against the shoulder 118 and/or against the wall portion 122, whilst the open end 22 thereof is stretched from outwardly of the hand first across the outwardly proximate plateau 10, across the open cantilever 5, and the opposing plateau 10. The retaining edge 11 and stretching of the balloon holds the balloon in the angled junction of the respective plateau 10 and edge 11. Then the open end 22 is wrapped around the side, bottom, and opposing side of the cantilever 5 until the stretched balloon crosses over itself. As noted above, additionally, a ribbon spool 110 can be positioned or mounted on a base to feed spooled ribbon 101 through the axially oriented recess 17. The thumb pressed against the shoulder 118, and/or on the wall portion 112, provide a good sealing line along the balloon to restrict escape of air or gas during the tying operation.

It should be noted that the 90 degree angle between the bottom edge 10 and the vertical retaining edge 11 provides for a stable platform so that the stretched balloon does not move forward along the cantilever 5 or backwards towards the base 1. (Subsequently after forming the knot, the curvature of the curved holding edge 9 aids in forcing the stretched balloon off the end of the cantilever 5 once the tail of the balloon is pulled outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15.)

The knot forming operation continues with the balloon neck or open end then passed over the portion stretched between the ears 7, then downwardly through the recess 17 proximate the base 1, under the portion stretched between the ears 7 and upwardly from the recess 17 proximate the end 15, forming a half-hitch knot 30 around the cantilever 5. The knot 30 is then easily slid distally off the cantilever 5 with the ribbon positioned integral or secured with the knot 30. The knot is rapidly pulled to tightness to complete the half-hitch knot with integral ribbon in the balloon to seal the same and hold compressed air or gas therein. The tail of the balloon is pulled outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15. The ribbon slides out of the gap of the flange 105 and the length of ribbon cut selectively. This enables tying individual ribbons for each balloon.

A balloon arch is readily constructed similarly. After receiving the device on the hand with the first two fingers proximate the thumb through the recess 3, a ribbon 101 is passed through the fingers and held in position in the cantilever 5, clear of the tying fingers, by the ribbon retainer 103 with the ribbon positioned in ribbon retainer slot 107 and the distal passageway gap 112.

An inflated balloon 20 is then held with the thumb 18 of the one hand 16 bearing the balloon against the shoulder 118 and/or against the wall portion 122, whilst the open end 22 thereof is stretched from outwardly of the hand first across the outwardly proximate plateau 10, across the open cantilever 5, and the opposing plateau 10. The retaining edge 11 and stretching of the balloon holds the balloon in the angled junction of the respective plateau 10 and edge 11. Then the open end 22 is wrapped around the side, bottom, and opposing side of the cantilever 5 until the stretched balloon crosses over itself. The thumb pressed against the shoulder 118, and/or on the wall portion 112, provides a good sealing line along the balloon to restrict escape of air or gas during the tying operation.

The 90 degree angle between the bottom edge 10 and the vertical retaining edge 11 provides for a stable platform so that the stretched balloon does not move forward along the cantilever 5 or backwards towards the base 1. The knot forming operation continues with the balloon neck or open end then passed over the portion of the balloon stretched between the ears 7, then downwardly through the recess 17 proximate the base 1, and upwardly from the recess proximate the end 15, forming a half-hitch knot 30 around the cantilever 5 and the stretched balloon end. The knot 30 is then easily slid distally off the cantilever 5 with the ribbon positioned integral or secured with the knot 30. The knot 30 is rapidly pulled to tightness to complete the half-hitch knot with integral ribbon secured in the knot of the balloon that seals the balloon and holds the compressed air or gas therein. This is accomplished by pulling the tail of the balloon rapidly and smoothly outwardly in a direction away from the base 1 from the cantilever 5 along a line substantially coaxial with a longitudinal axis of the cantilever. Pulling the tail pulls the stretched balloon portions along the arcuate edge 9 and past or over the radiused portion 13 of the end 15. The ribbon slides out of the gap of the flange 105. A lighter-than-air balloon will then float upwardly pulling the ribbon through the passageway 112. After a selected length, the ribbon is stopped, and the inflated balloon tying operation is performed for a subsequent balloon. This enables tying a balloon archway having a continuous ribbon through multiple balloons or, alternatively, by cutting the ribbon to selected length, having individual ribbons for each balloon.

The device can be used to tie a knot in any material which can be wrapped around the cantilever, passed through the recess 17, and pulled therefrom, and particularly for knotting or tying a balloon, in reference to FIGS. 6A-6H illustrating operation of the balloon tying device of FIG. 1 according to the present invention.

Figure 6A:
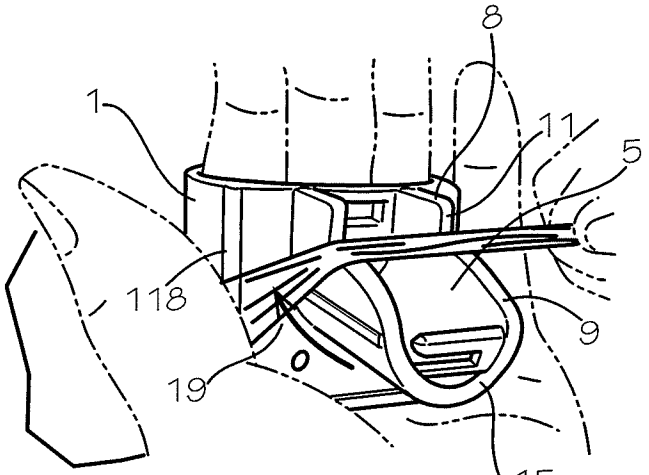
FIGS. 6A-6H illustrate operation of the balloon tying device of FIG. 1 according to the present invention.
Figure 6B:
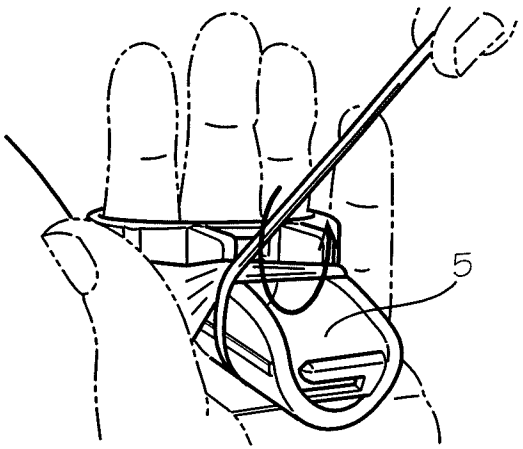
Figure 6C:
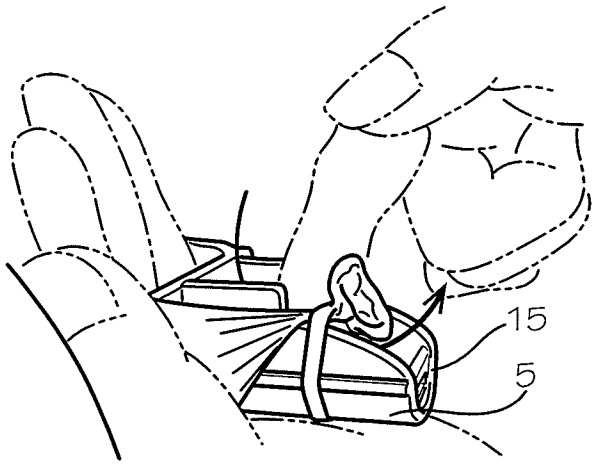
Figure 6D:
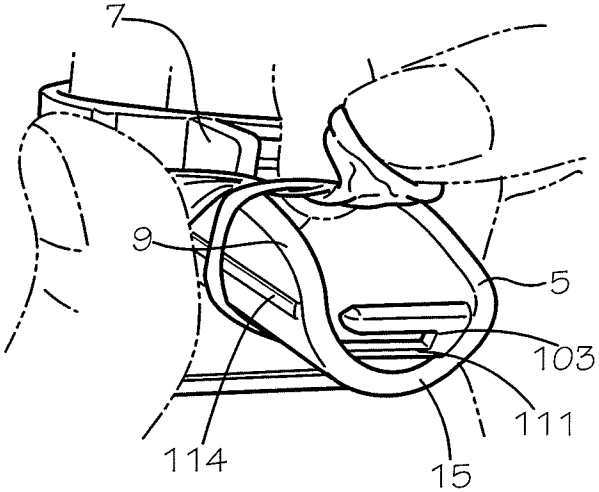
Figure 6F:
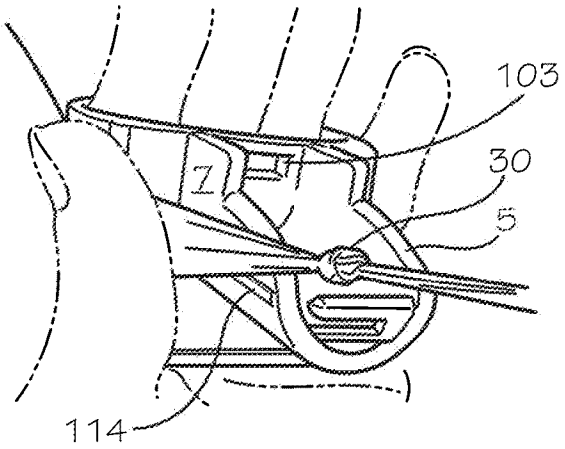
Figure 6E:
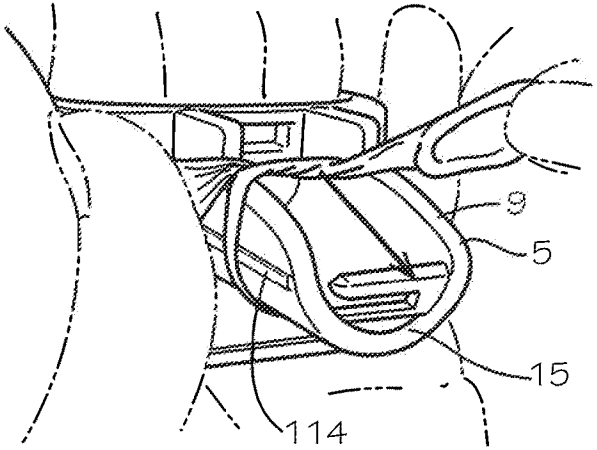
Figure 6H:
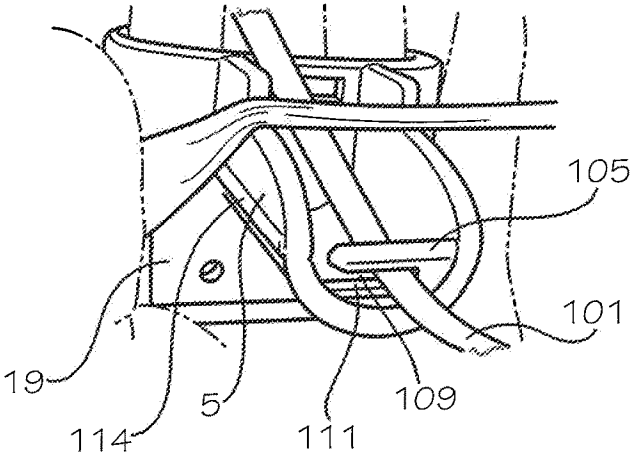
Figure 6G:
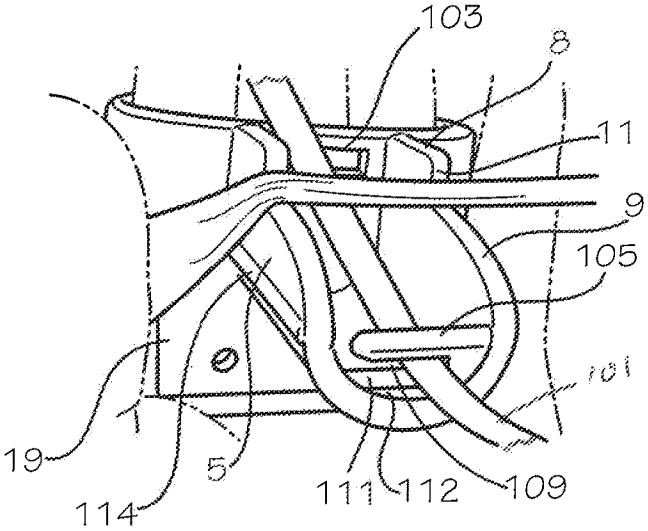

FIG. 6A illustrates the device on three fingers of an operator's hand and the thumb pressing a portion of the inflated balloon against the shoulder 118 and pulling a tail end of the balloon laterally across the plateaus 10 and the open cantilever 5. FIG. 6B illustrates the stretched balloon tail wrapped across a side, under the cantilever, and across the proximate side in preparing for forming the knot 30. FIG. 6C illustrates the leading edge of the tail of the balloon inserted over the initially stretched portion of the balloon and downwardly into the recess 17 proximate the base 1, with the leading end then pushed upwardly from the recess proximate the end 15. FIG. 6D illustrates the tail end of the balloon grabbed for detaching from the device. FIGS. 6E and 6F illustrate the operator pulling the tail end tail of the balloon rapidly and smoothly outwardly in a direction away from the base 1 from the cantilever 5 along a line substantially coaxial with a longitudinal axis of the cantilever. Pulling the tail pulls the stretched balloon portions along the arcuate edges 9 and past or over the radiused portion 13 of the end 15. The ribbon 101 (not illustrated in FIG. 6E or 6F) if present slides out of the gap 109 of the flange 105. FIG. 6G illustrates positioning the ribbon 101 though the fingers, through the retainer slot 107 of the ribbon retainer 103 in the base 1, in the recess 17 of the cantilever 5, and through the passageway 112 for arch balloon construction. Alternatively, as shown in FIG. 6H, a ribbon 101 may be received in the slot 109 for attachment and subsequent quick release therefrom for single balloon construction without passing through the slot 107 in the base 101.

It thus is seen that the device provides an easier manner of tying a balloon by a device with one or more structural features disclosed herein by providing shoulders which aid in sealing the neck of the balloon, a surface lateral of an ear of a cantilever that aids in sealing the neck of the balloon, an angled slot floor for directing the ribbon downwardly into the U-shaped valley of the cantilever for ease of grasping and positioning of ribbon for securing to a knot of a tied balloon, exterior ridge(s) which aid in slipping the balloon off the cantilever due to the reduced frictional contact area between the balloon and the cantilever, the matte finish for further reducing frictional contact during a removal step, an acruate distal edge of a brace tab for distribution of loading during balloon tying operations, and a planar bevel surface in a back side-palm side surface of a brace tab for distribution of loading during balloon tying operations.

Figure 7:
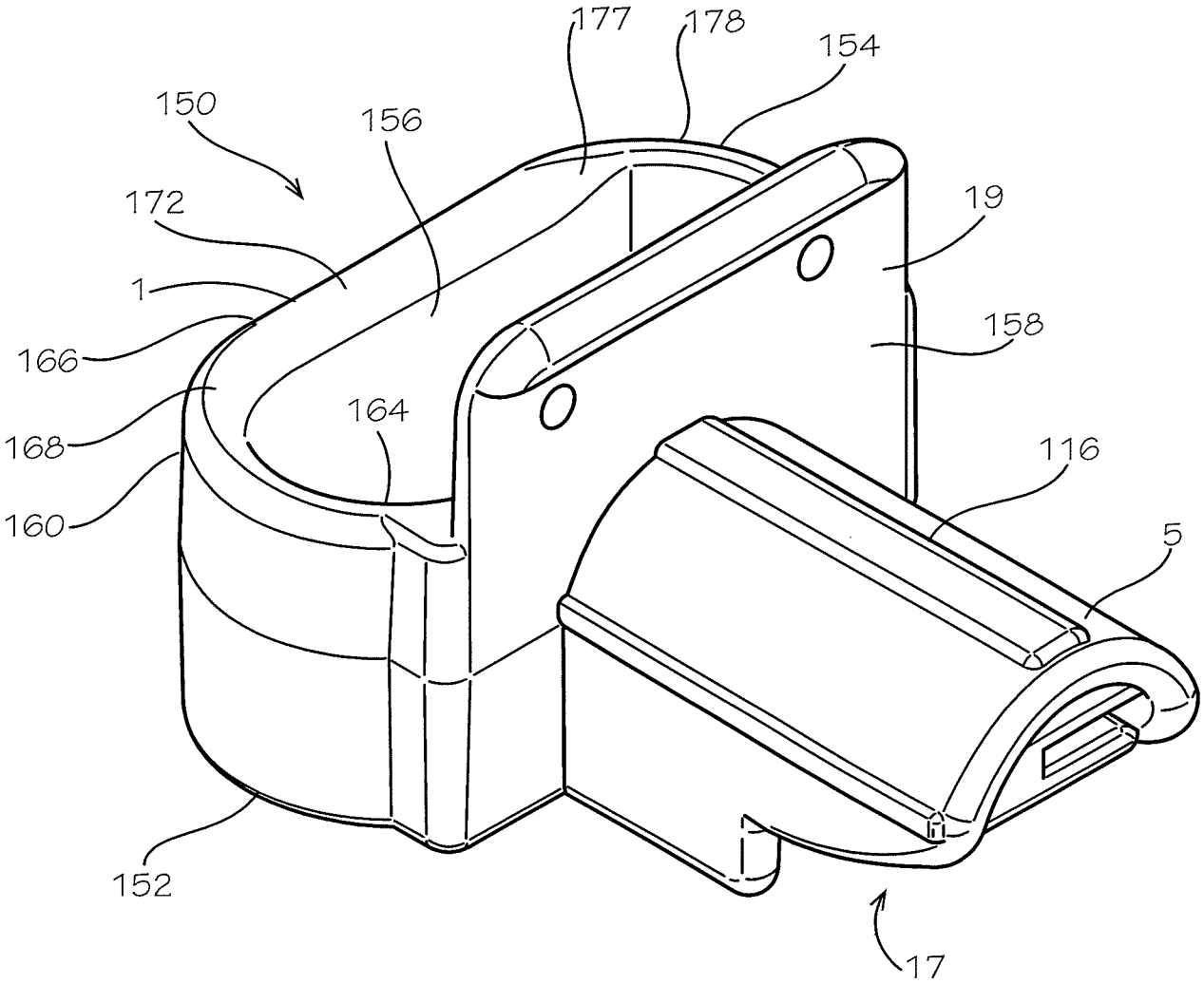
FIG. 7 illustrates in bottom perspective view an improved embodiment providing for comfortable holding of a balloon tying device for use in tying knots in necks of balloons.

FIG. 7 illustrates in bottom perspective view an improved embodiment balloon tying device 150 providing for comfortable operational fitting and holding on a hand of a person during use in tying knots in necks of balloons 20. The base 1 in the illustrated embodiment is hollow with a generally oblong shaped opening as defined by a vertically extending tube configured for receiving a support structure. The tube has a first end 152 and an opposing second end 154 joined by a back side transition 156 and an opposing front side transition 158 that defines the extending brace tab 19. In the illustrated embodiment, the opposing first end 152 and second end 154 are arcuate shaped. The elongated channel or recess 17 extends outwardly as a cantilever from the front side transition 158.

Figure 8:
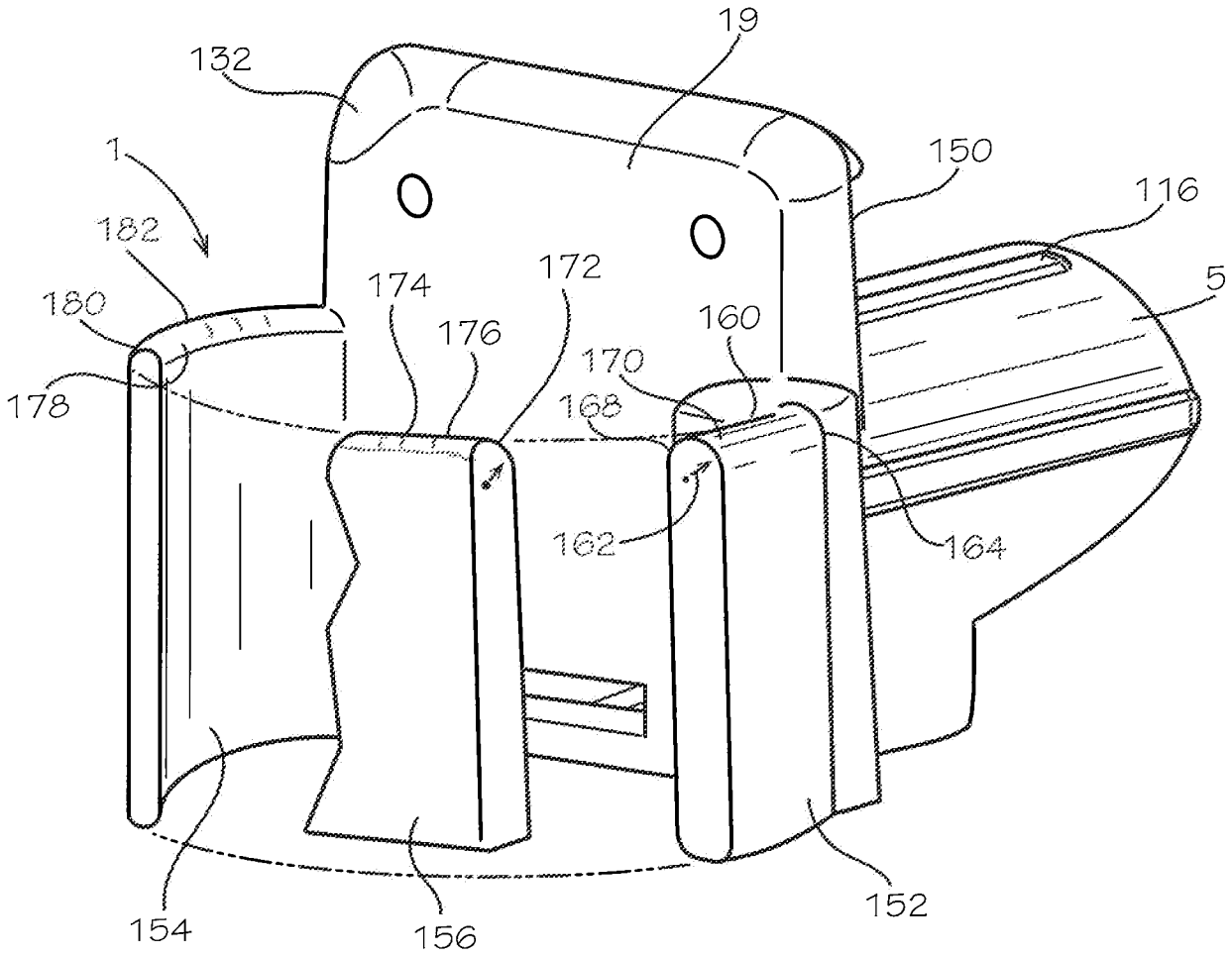
FIG. 8 illustrates in cross-sectional views the tubular base of the balloon tying device show in FIG. 7 structured for reducing hand fatigue and bruising while holding the device for extended periods involved in tying of balloon necks for a plurality of balloons.

FIG. 8 illustrates in cross-sectional views the tubular base 1 of the balloon tying device 150 structured for reducing hand fatigue and bruising while holding the device for extended periods involved in tying of balloon necks for a plurality of balloons. The first end 152, the back side transition 156 and the second end 154 have a respective lower distal extent or surface. The distal extent of the first end 152 defines a radiused arcuate surface 160 having a radius 162. The radius 162 is dependent on the wall thickness. The radiused surface 160 extends from a first portion 164 proximate an edge of the front side transition 158 to a second portion 166 at the back side transition 156. The radiused surface 160 has an inward arcuate surface 168 and an outward arcuate surface 170.

The inward arcuate radiused surface 168 on the distal extent continues on an inward side 172 of the distal extent of the back side transition 156 and therealong to the second end 154. The radius of the raidused inward side 172 may be the same as the radius for the radiused surface 160. The radius is based on the wall thickness. An opposing outward surface 174 of the distal extent of the back side transition 156 defines a rounded edge thereat. The surface 174 may terminate to define a planar surface 176 between the rounded surface 174 and the inward radiused surface 172.

As shown in FIG. 7, the back side transition 156 tapers to the second end 154. The inward radiused surface 172 tapers 177 from a radiused surface to a rounded edge 178 on the inward surface of the second end 154. The rounded outer surface 174 continues as a rounded surface 180 on an outward surface of the distal extent of the second end 154. The opposing rounded surfaces 178 and 180 in one embodiment may taper together. In another embodiment as illustrated in FIG. 8, the extents of the rounded surfaces 178 and 180 are separated by a planar surface 182 defining the distal end of the lower edge of the second end 154.

During use of the balloon tying device 150 in the manner discussed above relative to FIGS. 6A-6H, two fingers of a hand of a person using the device extend though the base 1. The radiused arcuate surface 160 of the first end 152 seats on a web of the person's hand between the adjacent fingers with the back side transition 156 outwardly of a back side of the fingers and the front side transition 158 overlying a palm side of the fingers. The radiused arcuate surface 160 seated on the web, cushions the loading and the movement of the portable balloon tying device 150 against the web which reduces fatigue and hurting of the hand during balloon tying use and enabling longer extended periods of knot tying the necks of balloons. The radiused surface 172 may contact the back side of the fingers which curved surface cushions from hurting by repeated loading and movement of the balloon tying device 150. The wall thickness of the first end 152 is preferably greater than the wall thickness of the opposing second end 154.

The disclosed balloon tying device 150 is particularly configured for use on a left hand of right-handed balloon inflatist, in that the radiused surface 160 is configured for being disposed during use between adjacent fingers while the opposing end 154 is configured with opposing rounded edges 178, 180 outwardly of the hand. In an alternate embodiment, the configuration of the base 1 may be mirrored to that disclosed herein, for configuration of the balloon tying device for use on a right hand suitable for a person who may be left-handed. Alternatively, an embodiment is configured with radiused lower edges along the entire perimeter of the base 1 and a second beveled face 132 is defined in an opposing lower edge portion of the brace tab 19 proximate a side edge and the distal end 121, such that the balloon tying device is usable by either right- or left-handed operators.

The forgoing describes the present invention in various illustrative embodiments of the invention. Those skilled in the art may recognize other equivalents to the specific embodiments described herein which equivalents are intended to be encompassed by the claims attached hereto.

What is claimed is:

1. A portable balloon tying device having improved operational fitting to a hand of a person for tying a knot in a neck of an inflated balloon, comprising:

a vertically extending tube configured for receiving a support structure, said tube having a first end and an opposing second end joined by a back side transition and an opposing front side transition;

an elongated channel extending outwardly as a cantilever from said front side transition; and the first end defining a lower extent as a radiused arcuate surface, whereby the radiused arcuate surface of the first end is configured to be received against a web of the hand between adjacent fingers of the person for using the portable balloon tying device with the back side transition configured to be received outwardly of a back side of the fingers and the front side transition configured to overlie a palm side of the fingers, and configured to cushion a loading and movement of the portable balloon tying device against the web during balloon tying use.

2. The portable balloon tying device as recited in claim 1, wherein the first end is arcuate.

3. The portable balloon tying device as recited in claim 2, wherein the second end is arcuate.

4. The portable balloon tying device as recited in claim 1, wherein the back side transition defines a lower extent of at least an inwardly radiused surface.

5. The portable balloon tying device as recited in claim 4, wherein the lower extent of the back side transition defines an outwardly rounded side edge opposing the inwardly radiused surface.

6. The portable balloon tying device as recited in claim 5, further comprising a planar surface between a respective extent of the outwardly rounded edge and the inwardly arcuate radius surface.

7. The portable balloon tying device as recited in claim 4, wherein the second end defines a lower extent of opposing rounded side edges.

8. The portable balloon tying device as recited in claim 7, further comprising a planar surface between a respective extent of the opposing rounded side edges.

9. A portable balloon tying device having improved operational fitting to a hand of a person for tying a knot in a neck of an inflated balloon, comprising:

a vertically extending tube configured for receiving a support structure, said tube having a first end and an opposing second end joined by a back side transition and an opposing front side transition;

the tube defining at a lower extent a radiused arcuate surface therealong of the first end, the back side transition, and the second end;

a brace tab extending from the front side transition and terminating at a distal edge for stabilized resting on a portion of a support structure during use of the balloon tying device;

a pair of opposing bevels each defined on a surface of the brace tab proximate a respective side edge and the distal end of the brace tab, for bearing contact with a portion of the support structure during use for balloon tying purposes; and an elongated channel extending outwardly as a cantilever from said front side transition;

whereby the radiused arcuate surface of the one of the respective first end and second end is configured to be received against a web of the hand between adjacent fingers of the person for using the portable balloon tying device for balloon tying purposes with the back side transition configured to be received outwardly of a back side of the fingers and the front side transition configured to overlie a palm side of the fingers, and configured to cushion a loading and movement of the portable balloon tying device against the web during use for balloon tying purposes.

* * * * *